US009084997B2

(12) United States Patent
Tanaami et al.

(10) Patent No.: US 9,084,997 B2
(45) **Date of Patent: *Jul. 21, 2015**

(54) CAPSULE AND CHEMICAL REACTION CARTRIDGE

(75) Inventors: Takeo Tanaami, Musashino (JP); Hisao Katakura, Musashino (JP); Nobuyuki Kakuryu, Musashino (JP); Saya Satou, Musashino (JP)

(73) Assignee: YOKOGAWA ELECTRIC CORPORATION, Tokyo (JP)

( * ) Notice: Subject to any disclaimer, the term of this patent is extended or adjusted under 35 U.S.C. 154(b) by 86 days.

This patent is subject to a terminal disclaimer.

(21) Appl. No.: 13/190,680

(22) Filed: Jul. 26, 2011

(65) Prior Publication Data

US 2011/0280776 A1 Nov. 17, 2011

Related U.S. Application Data

(63) Continuation of application No. 12/576,586, filed on Oct. 9, 2009.

(30) Foreign Application Priority Data

Nov. 14, 2008 (JP) ..... 2008-291979
Jun. 23, 2009 (JP) ..... 2009-148332

(51) Int. Cl.
*B01L 3/00* (2006.01)

(52) U.S. Cl.
CPC ..... *B01L 3/523* (2013.01); *B01L 3/5027* (2013.01); *B01L 2200/16* (2013.01); *B01L 2300/0867* (2013.01); *B01L 2400/0481* (2013.01); *B01L 2400/0683* (2013.01); *Y10T 428/13* (2015.01)

(58) Field of Classification Search
CPC ..... B01L 2400/0481; B01L 2400/0683
USPC ..... 422/554, 547, 551
See application file for complete search history.

(56) References Cited

U.S. PATENT DOCUMENTS

| | | | | | |
|---|---|---|---|---|---|
| 4,522,622 | A | * | 6/1985 | Peery et al. | 604/191 |
| 5,061,446 | A | | 10/1991 | Guigan | |
| 5,290,518 | A | * | 3/1994 | Johnson | 422/413 |
| 2004/0254559 | A1 | | 12/2004 | Tanaami et al. | |

FOREIGN PATENT DOCUMENTS

| | | | |
|---|---|---|---|
| JP | 60-163240 | U | 10/1985 |
| JP | 04-057751 | A | 2/1992 |
| JP | 11-009337 | A | 1/1999 |
| JP | 2005-037368 | A | 2/2005 |
| WO | 2004/020296 | A1 | 3/2004 |

OTHER PUBLICATIONS

Notice of Reason for Rejection dated Oct. 30, 2013, issued in Japanese application No. 2009-148332, w/ English translation.

* cited by examiner

*Primary Examiner* — Natalia Levkovich
(74) *Attorney, Agent, or Firm* — Westerman, Hattori, Daniels & Adrian, LLP

(57) ABSTRACT

There are provided a capsule and a chemical reaction cartridge capable of properly handling reagents and so forth. The capsule is formed by laminating two dome-shaped films together at the peripheries thereof. The films are formed by subjecting heat sealable films, to which aluminum vapor deposition is applied, to a drawing process. The films are made of a material (easy-peel material), which can be varied in seal strength by a heating temperature and are thermally welded together at an adhesion area at the peripheries thereof. Thereafter, contents such as reagents and so forth are filled up inside the capsule via a filling section.

4 Claims, 9 Drawing Sheets

52
52a
52c
52b
12
11
1

52
52a
52b
1

52
52a
52b
1

53

54

55

CAPSULE AND CHEMICAL REACTION CARTRIDGE

INCORPORATED-BY-REFERENCE TO RELATED APPLICATIONS

This application is a continuation application of U.S. Ser. No. 12/576,586, filed Oct. 9, 2009, and is based upon and claims the benefit of priority from the prior Japanese Patent Application No. 2008-291979, filed on Nov. 14, 2008 and Japanese Patent Application No. 2009-148332, filed Jun. 23, 2009, the entire contents of which are incorporated by reference.

FIELD OF THE INVENTION

The present invention relates to a chemical reaction cartridge capable of causing deformation to occur thereto upon application of an external force thereto for transferring contents thereof, thereby causing chemical reaction to proceed, and a capsule to be used with the combination of the chemical reaction cartridge.

BACKGROUND OF THE INVENTION

There is known a chemical reaction cartridge capable of causing deformation to occur thereto upon application of an external force thereto for transferring contents thereof, thereby causing chemical reaction to proceed, for example, as disclosed in JP 2005-37368A. This chemical reaction cartridge is provided with wells and flow paths whose shapes and arrangements are adapted to a predetermined chemical reaction procedure, wherein a roll pressed against the cartridge is moved to transfer the contents, thereby causing the chemical reaction to proceed with ease in accordance with the procedure described above.

Reagents necessary for causing chemical reaction to proceed in the chemical reaction cartridge are needed to be filled up in advance in wells of the cartridge. However, a material constituting the chemical reaction cartridge is made of an elastic resin such as a silicone rubber, and so forth and is large in gas permeability. Further, a solvent such as an alcohol and so forth is liable to permeate the elastic resin to be diffused therein. To that end, there is a problem in that some types of reagents are not preserved in the cartridge for a long period.

Further, there is another problem in that it is very difficult to introduce a given amount of reagents filled up in the cartridge into a next well so as to be reproducible, causing it difficult to avoid waste of reagents and to cause stable reaction to proceed.

Still further, there is yet another problem in that when reagents are filled up in the well for storing the reagents using a syringe or a pipette from the outside, air inside the well is not removed to be residual therein, or air bubbles are liable to be mixed in the well when or after the reagents are filled up in the well. Since such air bubbles exert a harmful influence upon a subsequent reaction and so forth, it is necessary to prevent the mixing of air bubbles into the well with safety.

SUMMARY OF THE INVENTION

It is an object of the invention to provide a capsule and a chemical reaction cartridge capable of properly handling reagents and so forth.

The capsule of the invention is a capsule for airtightly storing a material to be supplied to a chemical reaction cartridge capable of causing deformation to occur thereto upon application of an external force thereto for transferring contents thereof, thereby causing chemical reaction to proceed, wherein the capsule is made of a material higher in airtightness than that of the chemical reaction cartridge and the material stored in the capsule is supplied to a prescribed area of the chemical reaction cartridge by squashing the capsule.

The capsule may be provided with a portion to be destroyed first by an internal pressure thereof wherein the material stored in the capsule is discharged from the portion to be destroyed when the capsule is squashed.

The capsule may be stored in the chemical reaction cartridge and is squashed by a force applied to the capsule from the outside of the chemical reaction cartridge.

The material stored in the capsule may be supplied to the chemical reaction cartridge when the capsule is squashed in a state where the capsule is inserted into the chemical reaction cartridge.

A plurality of capsules may be inserted into the chemical reaction cartridge in a state where the plurality of capsules is coupled to each other.

The chemical reaction cartridge of the invention is a chemical reaction cartridge capable of causing deformation to occur thereto upon application of an external force thereto for transferring contents thereof, thereby causing chemical reaction to proceed, wherein a capsule made of a material higher in air-tightness than that of the chemical reaction cartridge and airtightly storing a material to be supplied to a prescribed area of the chemical reaction cartridge is stored in the chemical reaction cartridge, and wherein the material stored in the capsule is supplied to a prescribed area of the chemical reaction cartridge by squashing the capsule by a force applied to the capsule from the outside of the chemical reaction cartridge.

BRIEF DESCRIPTION OF THE DRAWINGS

FIG. 1 is a view of a capsule according to one embodiment of the invention, wherein

FIG. 2 is a view showing the configuration and so forth of the capsule, wherein

FIG. 4 is a view of a capsule according to another embodiment of the invention wherein

FIG. 5 is a view showing an example of capsules coupled to each other, wherein

FIG. 6 is a view showing another example of capsules coupled to each other, wherein

FIG. 7 is a view showing an example of the configuration of a bendable cassette, wherein

FIG. 8 is a view showing an example of the configuration of a jig for squashing the capsule, wherein FIG. 9 is a view showing an example of the operation of hold-down rings for pressing peripheries of capsules, wherein

DETAILED DESCRIPTION OF THE PREFERRED EMBODIMENTS

An embodiment of a capsule according to the invention is described hereinafter.

Figure 1A:
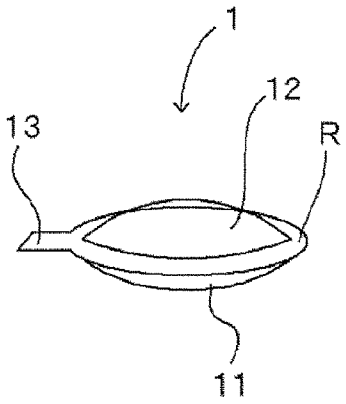
FIG. 1(A) is a perspective view showing a shape of the capsule.
Figure 1B:
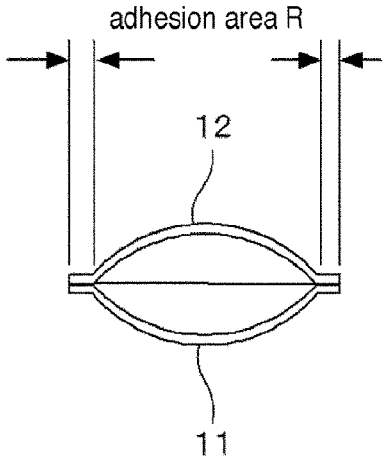
FIG. 1(B) is a cross-sectional view showing the configuration of the capsule shown in FIG. 1(A), FIG. 1(C) and FIG. 1(D) are perspective views each showing how to use the capsule.

FIG. 1(A) is a perspective view showing a shape of the capsule according to one embodiment, and FIG. 1(B) is a cross-sectional view showing the configuration of the capsule shown in FIG. (A).

As shown in FIG. 1(A) and FIG. 1(B), a capsule 1 is formed by laminating two dome-shaped films 11 and 12 together at the peripheries thereof. The films 11 and 12 are formed by subjecting heat sealable films, to which aluminum vapor deposition is applied, to a drawing process. The films 11 and 12 are made of a material (easy-peel material), which can be varied in seal strength by a heating temperature and are thermally welded together at an adhesion area R at the peripheries thereof. Thereafter, contents such as reagents and so forth are filled up inside the capsule 1 via a filling section 13.

Figure 1C:
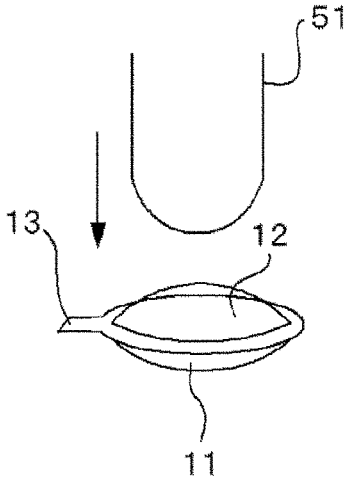
Figure 1D:
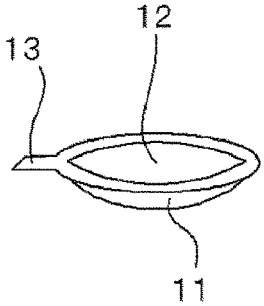
Figure 1E:
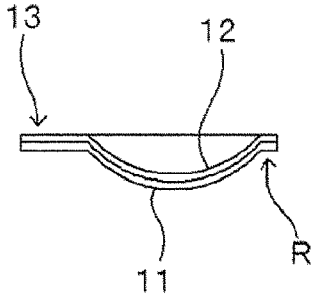
FIG. 1(E) is a cross-sectional view of the capsule.

FIG. 1(C) and FIG. 1(D) are perspective views each showing how to use the capsule 1, and FIG. 1(E) is a cross-sectional view of the capsule 1.

As shown in FIG. 1(C), if a jig 51 or the like is pushed into the capsule 1, the film 12 is deformed to have an inverted shape. Since the shapes of the films 11 and 12 are the same at this point in time, the film 12 is brought into close contact with the film 11 (FIG. 1(D) and FIG. 1(E)), so that a dead space is not produced, thereby completely discharging the contents. Further, it is possible to supply fluid without wasting reagents and without mixing of air bubbles in the contents.

Figure 2A:
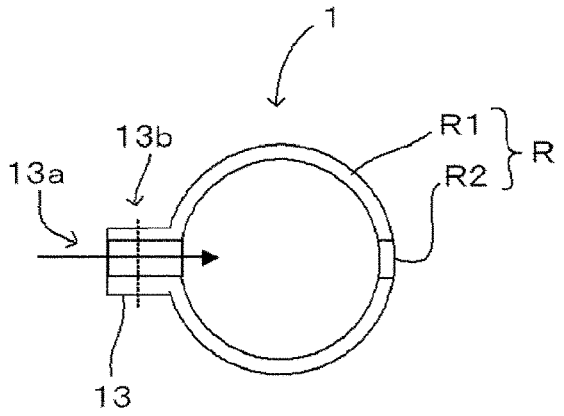
FIG. 2(A) is a plan view showing a state of an adhesion area R.
Figure 2B:
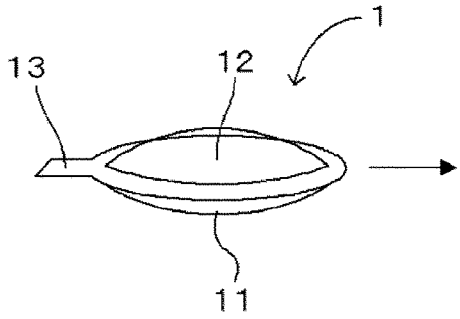
FIG. 2(B) is a perspective view showing a state where contents are discharged.

FIG. 2(A) is a plan view showing a state of an adhesion area R, and FIG. 2(B) is a perspective view showing a state where the contents are discharged.

As shown in FIG. 2(A), the adhesion area R is provided along the outer peripheral edge of the capsule 1 avoiding a central area of a filling section 13. The central area of the filling section 13 is used as a filling port 13*a* to be used when filling up the contents in the capsule 1.

The adhesion area R comprises an area R1 having a strong adhesion force and an area R2 having a weak adhesion force. When manufacturing the capsule 1, the area R is first thermally welled at a low temperature, thereby laminating the films 11 and 12 together in a whole with an adhesion force corresponding to that of the area R2. Subsequently, the area R1 is thermally welded at a high temperature to increase the adhesion force. The films 11 and 12 are laminated together by such a two-step sealing.

When filling up the contents in the capsule 1, the contents are injected into the capsule 1 by inserting injector and so forth through the filling port 13*a* of the filling section 13. Subsequently, a sealing section 13*b* as depicted by dotted lines is thermally welded at a high temperature, thereby tightly encapsulating the contents in the capsule 1. In the case where air bubbles are mixed in contents when filling up the contents in the capsule 1, the capsule 1 may be disposed of as a defective product.

As shown in FIG. 2(B), when the capsule 1 is squashed, the films 11 and 12 are peeled off at the area R2 having a weak adhesion force, and the contents are discharged from a peeled-off section, i.e. a gap between the films 11 and 12.

Figure 2C:
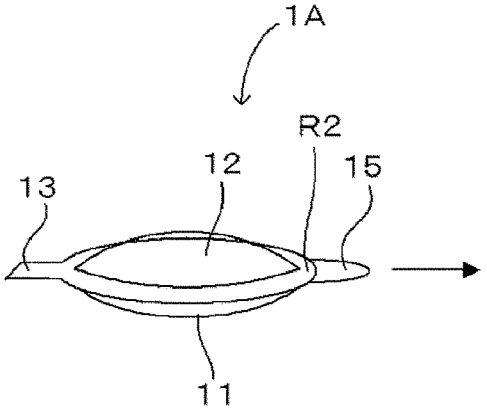
FIG. 2(C) is a perspective view showing the capsule wherein a discharge path is provided at the portion through which the contents are discharged.
Figure 2D:
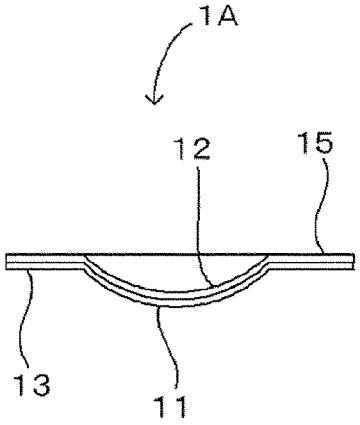
FIG. 2(D) is a cross-sectional view shown in FIG. 2(C)

FIG. 2(C) is a perspective view showing the capsule wherein a discharge path is provided at the portion through which the contents are discharged, and FIG. 2(D) is a cross-sectional view of the capsule shown in FIG. 2(C).

As shown in FIG. 2(C) and FIG. 2(D), a capsule 1A has the configuration wherein a discharge path 15, extended from the area R2, is added to the capsule 1. If the capsule 1A is squashed, the films 11 and 12 are peeled of at the area R2 so that the contents flow through the discharge path 15, and are discharged from the tip end of the discharge path 15.

According to the capsule 1 shown in FIG. 1 and FIG. 2, the contents can be tightly encapsulated in the capsule 1 formed of aluminum laminated films that are excellent in resistance to solvents and gas barrier properties, so that reagents to be prepared at the time of use, and so forth, that are needed to be mixed with each other immediately before being used, can be stably preserved for a long period.

Further, the contents inside the capsule can be regulated in a given amount with ease and the discharge of the full amount of contents can be controlled with ease depending on operation conditions of an actuator when squashing the capsule. Still further, since the capsule 1 is symmetrical at the upper and lower surfaces, so that the upper film serving as the upper surface of the capsule 1 is inverted, to be in close contact with the film 11 serving as the lower surface, thereby preventing the production of a dead space. As a result, the contents do not remain in the capsule 1. For this reason, a given amount of contents can be discharged in the capsule 1 so as to be well reproducible.

Further, since the contents can be filled up in the capsule in a state where air bubbles are not mixed in the contents, it is possible to prevent the air bubbles from being mixed in the contents to be discharged.

Figure 3:
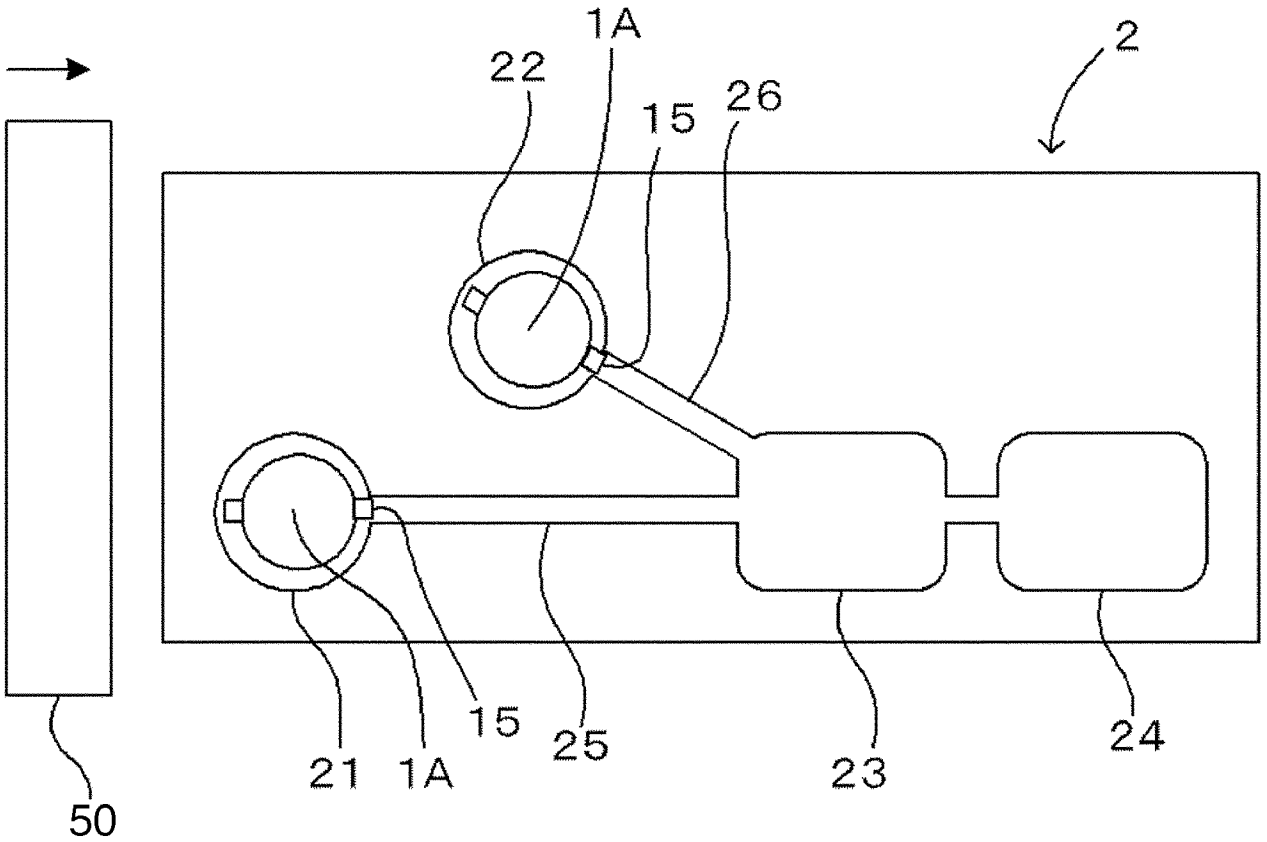
FIG. 3 is a plan view showing an example of capsules stored in the chemical reaction cartridge.

FIG. 3 is a plan view showing an example of capsules stored in the chemical reaction cartridge.

As shown in FIG. 3, wells 21 to 24 and flow paths 25 and 26, and so forth are formed inside the chemical reaction cartridge 2 to be adapted to a shape and arrangement in accordance with a desired chemical reaction procedure. The chemical reaction cartridge 2 is made of an elastic material such a silicone rubber and so forth and provided with wells and flow paths, so that the chemical reaction can be executed with ease in accordance with the foregoing procedure by moving a roller 50 pressed against the chemical reaction cartridge 2.

In the example shown in FIG. 3, each capsule 1A is stored in the well 21 and well 22 of the cartridge 2. A shown in FIG. 3, each capsule 1A is arranged in the manner that each discharge path 15 of the capsule 1A is inserted into flow paths 25 and 26 leading to a subsequent well 23. When the capsule 1A is squashed via the cartridge 2, the content of each capsule 1A is supplied toward the flow paths 25 and 26. If the roller 52 is subsequently moved, it is possible to execute a predetermined chemical reaction.

FIG. 4 is a view of a capsule according to another embodiment of the invention.

Figure 4A:
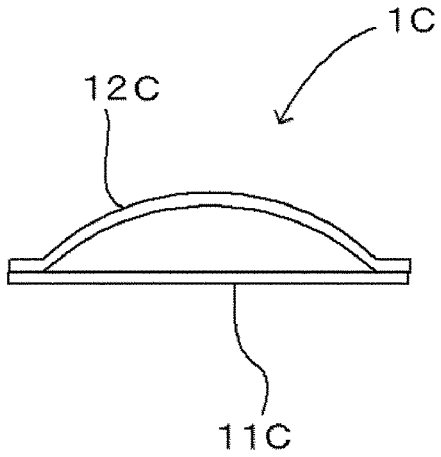
FIG. 4(A) is a cross-sectional view of the capsule formed by the combination of a flat film and a dome-shaped film.

FIG. 4(A) is a cross-sectional view of the capsule formed by the combination of a flat film and a dome-shaped film. As shown in FIG. 4(A), the capsule 1C is configured by laminating a flat film 11C and a dome-shaped film 12C together. In this case, when the film 12C is squashed, the contents in the capsule 1C can be discharged.

Figure 4B:
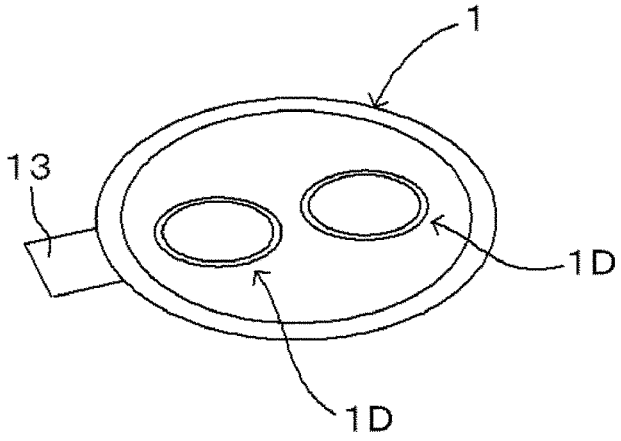
FIG. 4(B) is a view showing an example of a capsule storing therein a plurality of capsules.

FIG. 4(B) is a view showing an example of a capsule storing therein a plurality of capsules.

According to the example of FIG. 4(B), two capsules 1D, 1D are stored in the capsule 1. Two capsules 1D, 1D encapsulate therein different kind of contents, and when the capsule 1 is squashed, both the capsules 1D, 1D are also squashed so that the contents are mixed together. As shown in FIG. 2(B), the mixed contents are discharged from a predetermined direction. With such a configuration, two contents can be mixed together at the time of use (prepared at the time of use). For example, such a configuration can be used, for example, when two fluids are caused to react with each other at the time of use.

The capsule 1 may be coupled to each other as shown in FIG. 5.

Figure 5A:
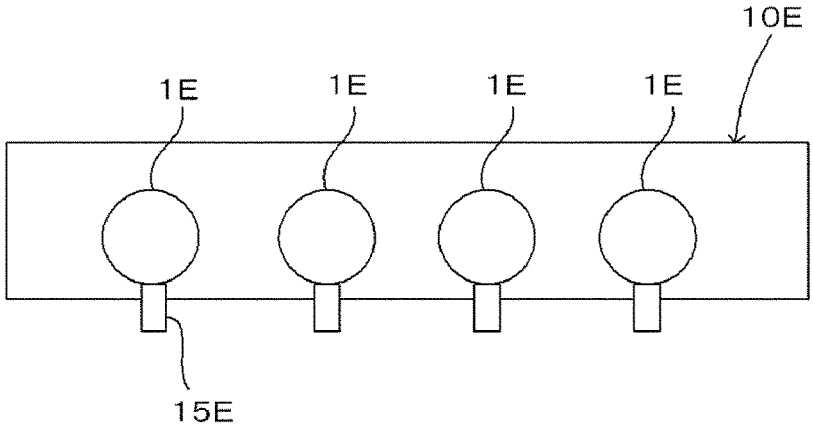
FIG. 5(A) is a plan view of the cassette.
Figure 5B:
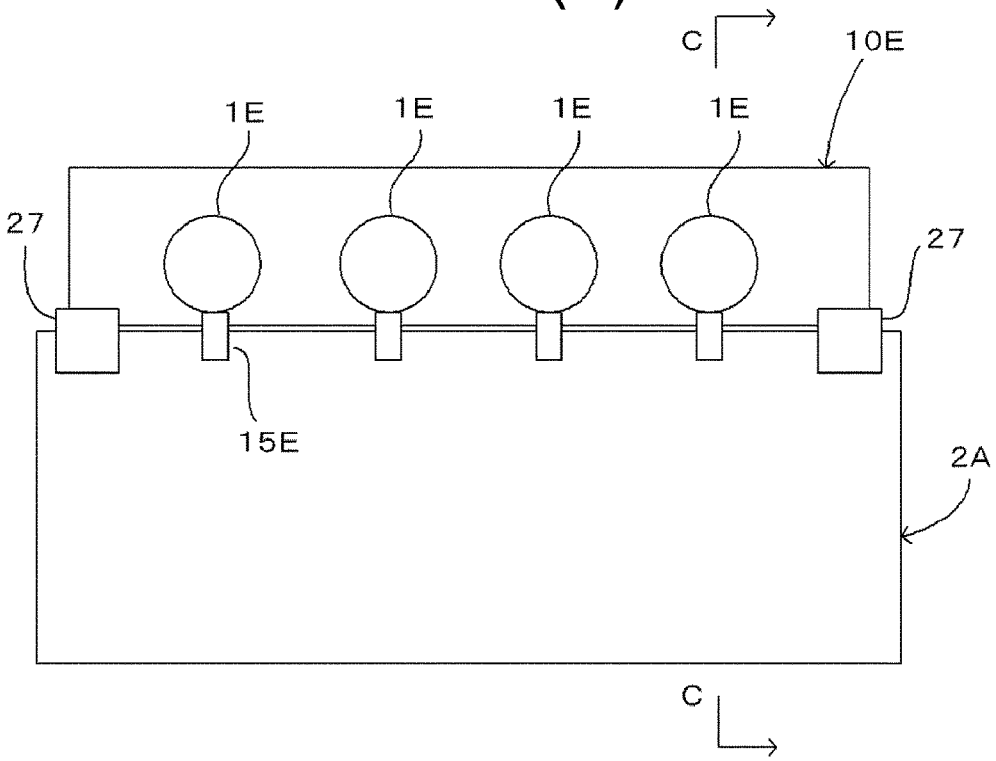
FIG. 5(B) is a cross-sectional view showing the cassette and a cartridge coupled to each other.
Figure 5C:
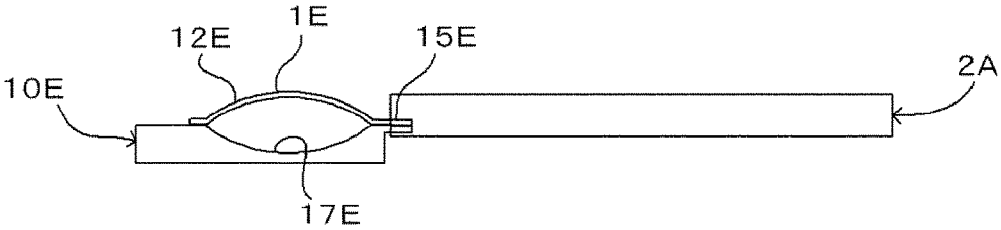
FIG. 5(C) is a cross-sectional view of the cassette and the cartridge coupled to each other and taken along the line C-C shown in FIG. 5(B)

FIG. 5 is a view showing an example of capsules coupled to each other, wherein FIG. 5(A) is a plan view of the cassette, and FIG. 5(B) is a cross-sectional view showing the cassette and a cartridge coupled to each other, and FIG. 5(C) is a cross-sectional view of the cassette and the cartridge coupled to each other and taken along the line of C-C in FIG. 5(B).

As shown in FIG. 5(A), four capsules 1E are formed in a cassette 10E made of a resin. As shown in FIG. 5(C), each capsule 1E is formed by adhering a periphery of a recess 17E, formed on a base section of the cassette 10E, to a dome-shaped film 12E.

A chemical reaction cartridge 2A has an internal structure corresponding to four capsules 1E, and as shown in FIG. 5(B), tip ends of the discharge paths 15E of the capsules 1E are inserted inside the chemical reaction cartridge 2A from the side of the chemical reaction cartridge 2A. By so doing, the chemical reaction cartridge 2A is reliably loaded with, for example, a set of necessary reagents through one-touch operation. If the coupled cassette 10E and the chemical reaction cartridge 2A can be fastened with dedicated coupling members 27 such as clips having a lock mechanism, thereby fixedly securing the cassette 10E and the chemical reaction cartridge 2A together. In this state, when the capsules 1E are squashed, the contents in the capsule 1E can be inserted into the chemical reaction cartridge 2A. At this point in time, the capsule 1E can be squashed in the manner that the capsules 1E are sandwiched between the recess 17E of the cassette 10E and the jig.

As mentioned above, when the capsules are built in the cassette, handling properties of the capsules are improved at the time of manufacturing the capsules or at the time when the cassette is loaded with the capsules. For example, in the case where a plurality of reagents are introduced in the cartridge 1E, one cassette can be loaded with the plurality of reagents at the same time, it is possible to prevent the arranging operation of the capsules from being erroneously executed.

Figure 6A:
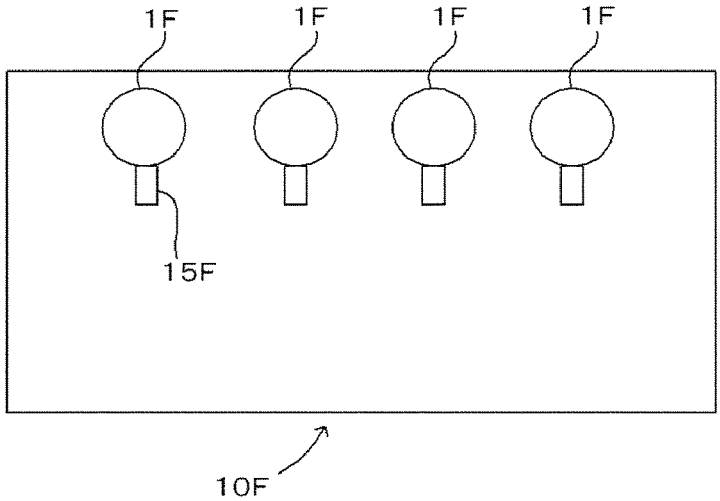
FIG. 6(A) is a plan view of the cassette.
Figure 6B:
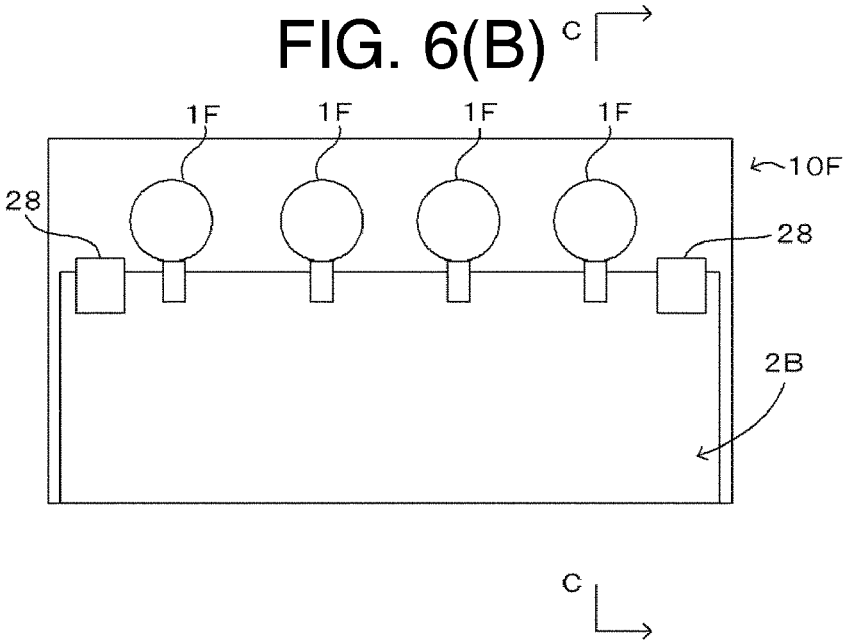
FIG. 6(B) is a cross-sectional view showing the cassette and a cartridge coupled to each other.
Figure 6C:
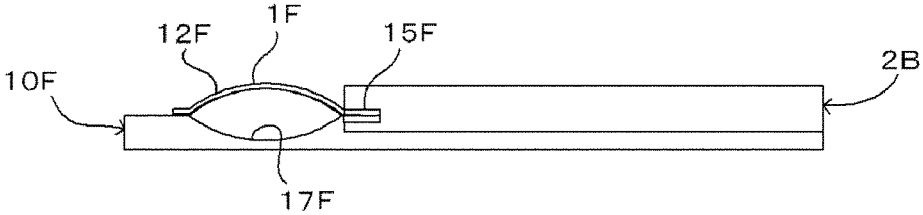
FIG. 6(C) is a cross-sectional view of the cassette and the cartridge coupled to each other and taken along the line C-C shown in FIG. 6(B)

FIG. 6 is a view showing another example of a cassette for coupling capsules with each other, wherein FIG. 6(A) is a plan view of the cassette, and FIG. 6(B) is a cross-sectional view showing the cassette and a cartridge coupled to each other, and FIG. 6(C) is a cross-sectional view of the cassette and the cartridge coupled to each other and taken along the line C-C shown in FIG. 6(B).

As shown in FIG. 6(C), each capsule 1F is formed by adhering a periphery of a recess 17F, formed on a base section of the cassette 10F, to the dome-shaped film 12F.

As shown in FIG. 6(A), the cassette 10F for coupling four capsules 1F with each other is enlarged in base portion compared with the cassette 10E in FIG. 5(A). As shown in FIG. 6(B) and FIG. 6(C), when the tip ends of discharge paths 15F of the capsules 1F are inserted from the side face of the cartridge 2B into the cartridge 2B and the cassette 10F and the cartridge 2B are fixedly secured to each other by coupling members 28, the base portion of the cassette 10F is render to be flush with the other face of the cartridge 2B. Accordingly, the base portion of the cassette 10F can be used as a foundation not only when the capsules 1F are squashed but also when fluid is supplied to the cartridge 2B by means of a roller and so forth.

Figure 7A:
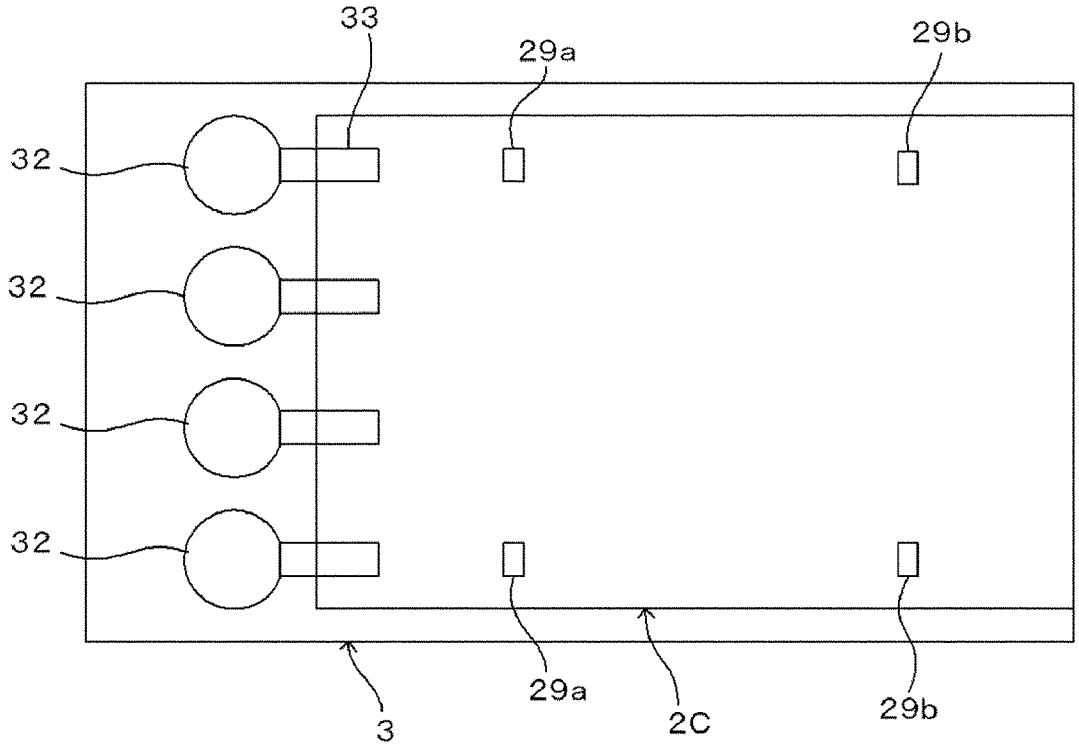
FIG. 7(A) is a plan view of the cassette.
Figure 7B:
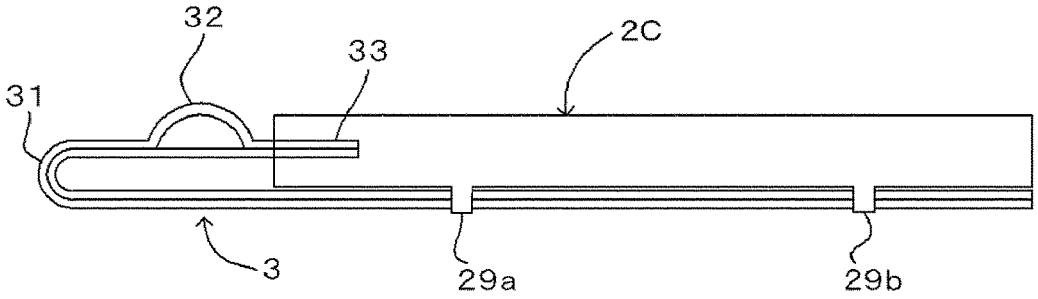
FIG. 7(B) is a cross-sectional view of the cassette shown in FIG. 7(A)

FIG. 7(A) is a view showing an example of the configuration of a bendable cassette, and FIG. 7(B) is a cross-sectional view of the cassette shown in FIG. 7(A).

As shown in FIG. 7(A) and FIG. 7(B), four capsules 32 and four discharge paths 33 for guiding contents to be discharged from each capsule 32 are built into the cassette 3, respectively. When the discharge paths 33 are inserted into a cartridge 2C and a bending portion 31 of the cassette 3 is bent, a chemical reaction cartridge 2C is loaded with the cassette 3. Projections 29*a* and 29*b* are provided in the chemical reaction cartridge 2C while holes (not shown) corresponding to the projections 29*a* and 29*b* are provided in the cassette 3, wherein the cassette 3 is fixedly secured to the chemical reaction cartridge 2C via the projections 29*a* and 29*b*.

FIG. 8 is a view showing an example of the configuration of a jig for squashing the capsule. The jigs shown in FIG. 8 are driven by an actuator or manually.

Figures 8A, 8B, 8C, 8D, 8E, 8F:
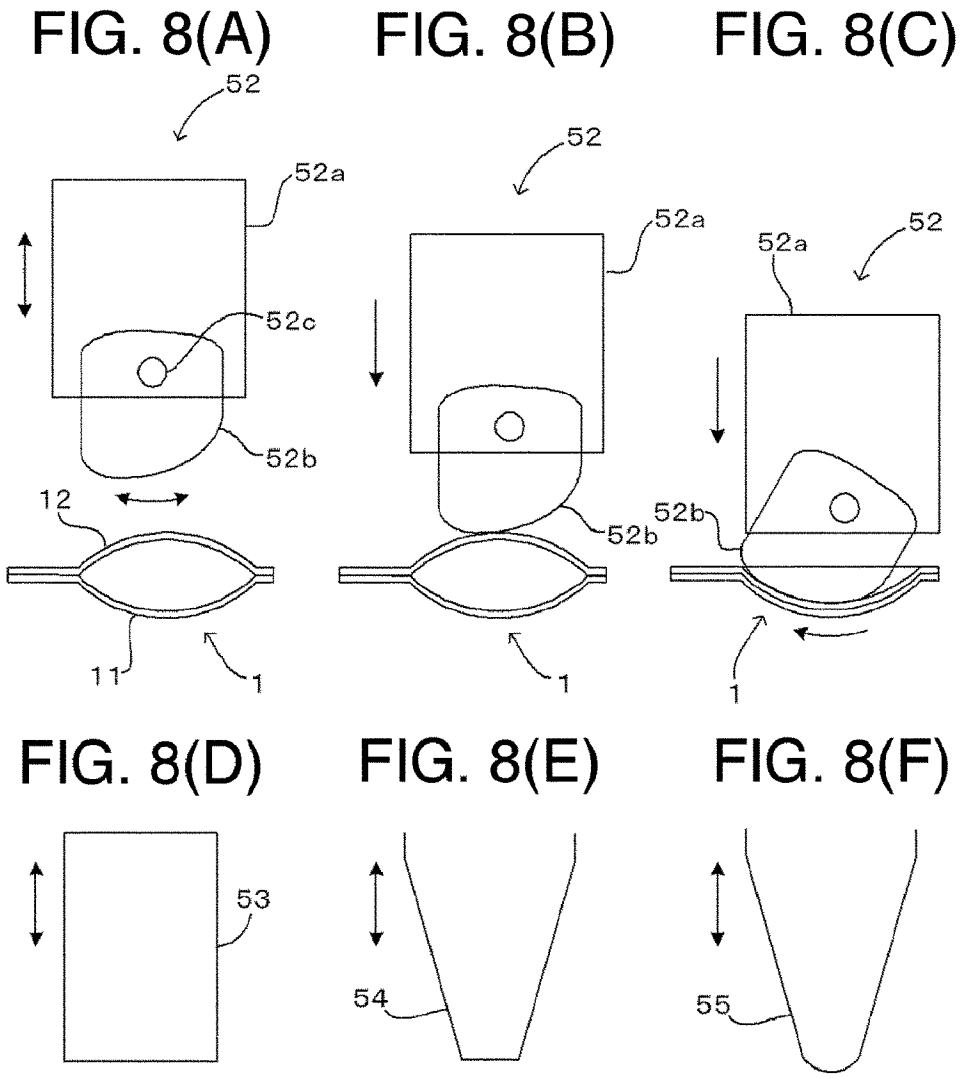
FIGS. 8(A) to 8(C) are plan views showing pushing operation of the jig into the capsule, FIG. 8 (D) is a view showing a jig having a flat tip end, FIG. 8 (E) is a view showing a taper-shaped jig, and FIG. 8 (F) is view showing a jig having a round shaped tip end.

FIG. 8(A) to FIG. 8(C) are plan views showing pushing operation of the jig 52 into the capsule. As shown in FIG. 8(A), the jig 52 comprises a base portion 52*a* that is driven up and down, and a tip end portion 52*b* that is rotatably fitted to a shaft 52*c* mounted on the base portion 52*a* to be movable around the shaft 52*c*. Since the tip end portion 52*b* is asymmetrical, when the base portion 52*a* is pressed down to press into the capsule 1, as shown in FIGS. 8(A) to 8(C), the tip end portion 52*b* is rotated clockwise as shown in FIG. 8(A) to FIG. 8(C). As a result, the contact portion between the tip end portion 52*b* and the capsule 1 is moved from the left side of the capsule 1 toward the right side of the capsule 1, the contents inside the capsule 1 can be efficiently discharged rightward. Meanwhile, in the case where the capsule 1 is stored in the chemical reaction cartridge, the tip end portion 52*b* of the jig may be pressed against the capsule 1 from the outside of the chemical reaction cartridge.

FIG. 8 (D) is a view showing a jig having a flat tip end. In the example of FIG. 8(A), a jig 53 is driven up and down, thereby uniformly squashing the entire capsule, so that the jig 53 is applied, for example, to the capsule as shown in FIG. 4(A).

FIG. 8 (E) is a view showing a taper-shaped jig, and FIG. 8 (F) is view showing a jig having a round shaped tip end.

Figure 9A:
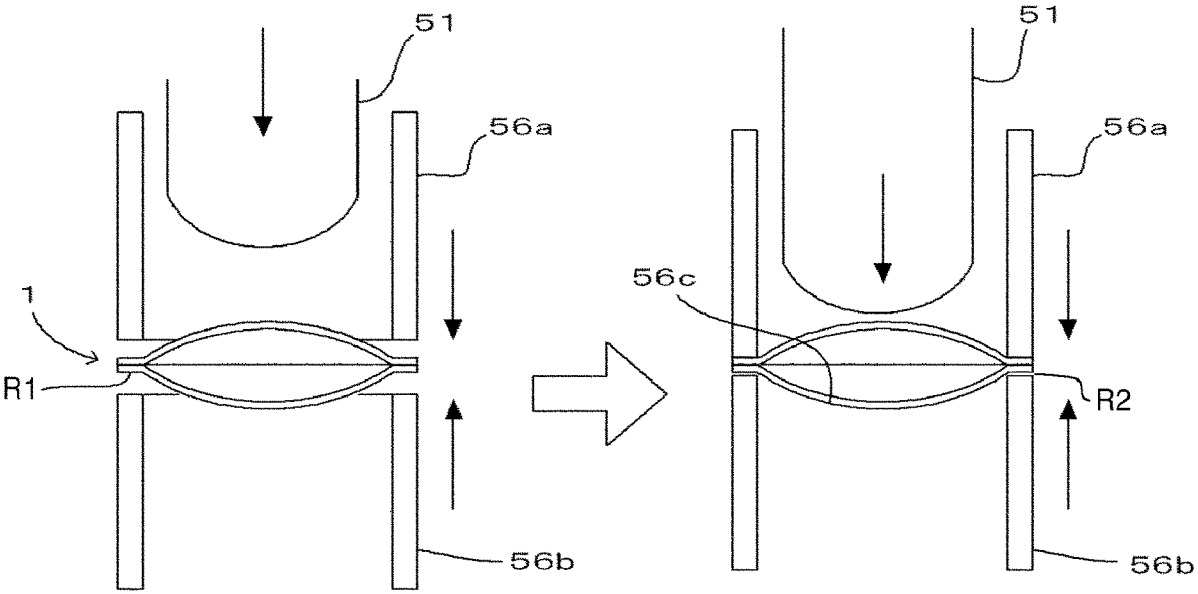
FIG. 9(A) is a cross-sectional view of the operation of hold-down rings.
Figure 9B:
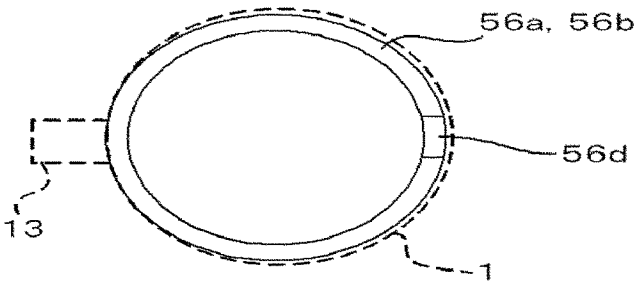
FIG. 9(B) is a plan view of the operation of the hold-down rings shown in FIG. 9(A).

FIG. 9 is a view showing an example of the operation of hold-down rings for pressing peripheries of capsules, wherein FIG. 9(A) is a cross-sectional view of the operation of hold-down rings, and FIG. 9(B) is a plan view of the operation of the hold-down rings shown in FIG. 9(A).

As shown in FIG. 9(A) and FIG. 9(B), the capsule 1 is squashed by the jig 51 in a state where the area R of the capsule 1 is clamped by a cylindrical hold-down ring 56*a* and a hold-down ring 56*b* having a recess 56*c* adapted to the shape of the capsule 1. A notch 56*d* is formed in the hold-down rings 56*a* and 56*b* at the portion corresponding to an area R2 of the capsule 1, wherein the contents of the capsule 1 are discharged through the notch 56*d*.

With the use of the hold-down rings, it is possible to prevent the capsule from being laterally slip off or prevent the contents of the capsule from being leaked around the capsule, thereby reliably ensuring the supply of fluid.

Meanwhile, in the case where the capsule is stored in the chemical reaction cartridge, the capsule may be pressed into the chemical reaction cartridge, from the outside of the chemical reaction cartridge.

For a material constituting the capsule according to the foregoing embodiments, it is sufficient to have resistance to solvents and gas barrier properties, and a resin laminated film containing a metal layer, PVA film, EVOH film, silica evaporated film, resin films such as PP, PC, PET and so forth, as well as aluminum as a film made of only metal can be used.

Further, the capsule may be formed by the combination of not less than three materials. For example, a polyhedral capsule such as a tetrapod is formed of not less than three materials.

For the capsule, an organic capsule for use in chemicals and foods may be used. In this case, the capsule may be formed by an instillation method or a rotary method. Further, it is possible to employ a capsule having the same configuration as a hard capsule for holding medical agents such as powdered medicine.

For the contents of the capsule, not only chemical reagents but also biochemical reagents, gases such as nitrogen, argon and so forth for fulfilling anaerobic condition, inactivation and so forth, and powder may be used. Further, the reagents can be preserved without deactivation by the use of a capsule filled with inert gases. Still further, a capsule may be formed of the combination of powder and solvent, fluid and solvent, gas and solvent.

Further, for a method of destroying a capsule, not only the method for squashing the capsule using an actuator and so forth, but also methods using a roller, stimulation by a needle, or heating may be employed.

Still further, the configuration for facilitating the mixture of the contents to be discharged from the capsule may be provided in the cartridge. For example, fluid paths through which the contents are discharged are bent, or shaped to form a barrier of the flow of the contents, thereby generating convection, so that the mixture of solutions and so forth can be improved.

The invention is not limited to the foregoing embodiments. The invention can be widely applied to a chemical reaction cartridge capable of causing deformation to occur thereto upon application of an external force thereto for transferring contents thereof, thereby causing chemical reaction to proceed, and a capsule to be used with the combination of the chemical reaction cartridge.

What is claimed is:

1. A capsule, comprising:

a first film and a second film, each having a respective adhesion area along a perimeter of the film, said adhesion areas being arranged along a common imaginary plane;

wherein said first film and said second film are directly laminated to each other at the entirety of the perimeters thereof, wherein said capsule is airtight and is capable of storing a material, wherein said adhesion areas include a weak adhesion area and a strong adhesion area, said adhesion areas being adhered by a two-step sealing operation including:

a first adhesion operation which weakly adheres areas of the first and second films corresponding to both the weak adhesion area and the strong adhesion area; and a second adhesion operation which strongly adheres only areas of the first and second films corresponding to the strong adhesion area, wherein said first and second films are more strongly adhered to each other in said strong adhesion area than in said weak adhesion area, and wherein said first and second films have mirror symmetry with respect to each other, relative to the imaginary plane.

2. An article, comprising:

a cassette comprising at least two recesses formed therein, the cassette having respective adhesion areas along a perimeter of each of the at least two recesses, and at least two films each having respective adhesion areas along a perimeter thereof, said adhesion areas of the cassette and said adhesion areas of the at least two films being arranged along a common imaginary plane, wherein each of said at least two films are directly laminated to the cassette at the entirety of the perimeters of each of said at least two recesses of the cassette, respectively, thereby forming at least two capsules, wherein said capsules are airtight and are capable of storing a material, wherein said adhesion areas each include a weak adhesion area and a strong adhesion area, said adhesion areas each being adhered by a two-step sealing operation including:

a first adhesion operation which weakly adheres areas of the first and second films corresponding to both the weak adhesion area and the strong adhesion area; and a second adhesion operation which strongly adheres only areas of the first and second films corresponding to the strong adhesion area, wherein tip ends of discharge paths corresponding to said weak adhesion areas protrude from said cassette, wherein said at least two films are more strongly adhered to the cassette in said strong adhesion area than in said weak adhesion area, and wherein said at least two films have mirror symmetry with respect to the recesses formed in the cassette, relative to the imaginary plane.

3. A device, comprising:

a capsule, comprising a first film and a second film, each having a respective adhesion area along a perimeter of the film, said adhesion areas being arranged along a common imaginary plane;

a chemical reaction cartridge capable of having said capsule inserted therein, said chemical reaction cartridge being deformable upon application of an external force thereto, wherein said first film and said second film are directly laminated to each other at the entirety of the perimeters thereof, wherein said capsule is airtight and is capable of storing a material, wherein said adhesion areas include a weak adhesion area and a strong adhesion area, said adhesion area being adhered by a two-step sealing operation including:

a first adhesion operation which weakly adheres areas of the first and second films corresponding to both the weak adhesion area and the strong adhesion area; and a second adhesion operation which strongly adheres only areas of the first and second films corresponding to the strong adhesion area, wherein said first and second films are more strongly adhered to each other in said strong adhesion area than in said weak adhesion area, and wherein said first and second films have mirror symmetry with respect to each other, relative to the imaginary plane.

4. A device, comprising:

an article, comprising:

a cassette comprising at least two recesses formed therein, the cassette having respective adhesion areas along a perimeter of each of the at least two recesses, and at least two films each having respective adhesion areas along a perimeter thereof, said adhesion areas of the cassette and said adhesion areas of the at least two films being arranged along a common imaginary plane; and a chemical reaction cartridge capable of having said article inserted therein, said chemical reaction cartridge being deformable upon application of an external force thereto, wherein each of said at least two films are directly laminated to the cassette at the entirety of the perimeters of each of said at least two recesses of the cassette, respectively, thereby forming at least two capsules, wherein said capsules are airtight and are capable of storing a material, wherein said adhesion areas each include a weak adhesion area and a strong adhesion area, said adhesion areas each being adhered by a two-step sealing operation including:

a first adhesion operation which weakly adheres areas of the first and second films corresponding to both the weak adhesion area and the strong adhesion area; and a second adhesion operation which strongly adheres only areas of the first and second films corresponding to the strong adhesion area, wherein tip ends of discharge paths corresponding to said weak adhesion areas protrude from said cassette, wherein said at least two films are more strongly adhered to the cassette in said strong adhesion area than in said weak adhesion area, and wherein said at least two films have mirror symmetry with respect to the recesses formed in the cassette, relative to the imaginary plane.

* * * * *